US006203955B1

(12) United States Patent
Mochizuki

(10) Patent No.: US 6,203,955 B1
(45) Date of Patent: Mar. 20, 2001

(54) DEVELOPING AGENT AND IMAGE FORMING APPARATUS

(75) Inventor: Takahiro Mochizuki, Komae (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/561,345

(22) Filed: Apr. 28, 2000

(51) Int. Cl.[7] ..... G03G 9/083; G03G 13/22; G03G 15/22

(52) U.S. Cl. ..... 430/106.6; 430/110; 430/126; 399/252

(58) Field of Search ..... 430/106.6, 110, 430/126; 399/252

(56) References Cited

U.S. PATENT DOCUMENTS 4,946,755 8/1990 Inoue ..... 430/106.6
5,272,040 * 12/1993 Nakasawa et al. ..... 430/110
5,747,211 * 5/1998 Hagi et al. ..... 430/110
5,776,646 * 7/1998 Hagi et al. ..... 430/106.6
5,981,132 * 11/1999 Kurose et al. ..... 430/110
6,103,441 * 8/2000 Tomita et al. ..... 430/110
6,114,077 * 9/2000 Voets et al. ..... 430/106.6

FOREIGN PATENT DOCUMENTS 1-40976 9/1989 (JP) .

* cited by examiner

*Primary Examiner*—Roland Martin
(74) *Attorney, Agent, or Firm*—Foley & Lardner

(57) ABSTRACT

A developing agent containing a binder resin, a magnetic particle, rutile/anatase mixed crystal type titanium oxide treated to have hydrophobicity, and silica treated to have hydrophobicity is used.

18 Claims, 1 Drawing Sheet

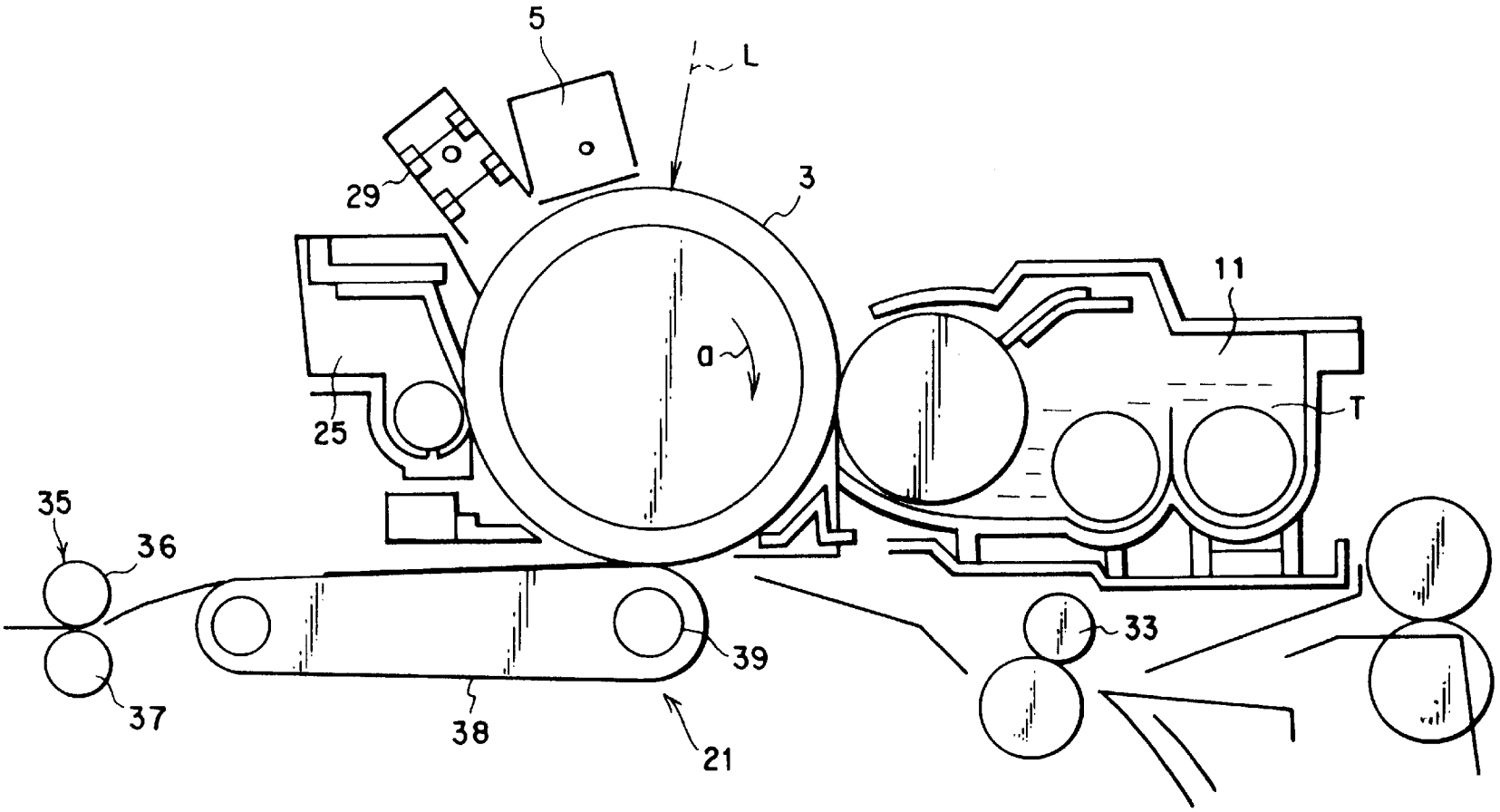
FIGURE

DEVELOPING AGENT AND IMAGE FORMING APPARATUS

BACKGROUND OF THE INVENTION

In an electrophotographic apparatus or an electrostatic recording apparatus, a two-component developing system method using toner and a carrier and a monocomponent developing system method using toner which also functions as a carrier are extensively used to visualize an electrostatic latent image formed on an image carrier made of a photoreceptor or a dielectric material.

These developing methods include methods using non-magnetic toner and magnetic toner.

As magnetic toner, Jpn. Pat. Appln. KOKAI Publication No. 1-40976 has disclosed one-component magnetic toner which contains, in toner particles, about 20 to 60 wt % of an iron oxide magnetic particle in which the FeO content, the number-average particle size, and the specific surface area are restricted to 16 to 25 wt %, 0.2 to 0.7 $\mu$m, and 2 to 10 $m^2/g$, respectively. Jpn. Pat. Appln. KOKAI Publication No. 1-40976 describes that when image formation is performed using this magnetic toner, a high developing efficiency and a high transfer efficiency can be obtained.

A magnetic material used herein has a high degree of blackness as a black pigment and can hold an appropriate electrical resistance. Hence, the material stabilizes the toner charge amount and can thereby improve image density. Also, in respect of developing properties, the material improves the rank of fog on image. However, with recent increasing speed of copying machines, magnetic toner cannot well satisfy high resolution, high durability, and the like any longer. Especially in a low-temperature, low-humidity environment, the charge amount cannot be properly controlled. A lowering of image density and background contamination resulting from an appropriate increase in charge amount cannot be well controlled.

BRIEF SUMMARY OF THE INVENTION

The present invention has been made in consideration of the above situation, and has as its first object to provide a developing agent having appropriate flowability, showing stable charging property and image density throughout its life, and capable of forming high-quality images.

It is the second object of the present invention to provide an image forming apparatus showing stable charging property and image density throughout its life and capable of forming high-quality images.

It is the third object of the present invention to provide an image forming method showing stable charging property and image density throughout its life and capable of forming high-quality images.

According to the first aspect of the present invention, there is provided a developing agent containing a binder resin, a magnetic particle, rutile/anatase mixed crystal type titanium oxide treated to have hydrophobicity, and silica treated to have hydrophobicity.

According to the second aspect of the present invention, there is provided an image forming apparatus comprising man image carrier, a developing device provided opposite to the image carrier, and containing a developing agent which contains a binder resin, a magnetic particle, rutile/anatase mixed crystal type titanium oxide treated to have hydrophobicity, and silica treated to have hydrophobicity, the developing device forming a developing agent image by developing an electrostatic latent image formed on the image carrier by using the developing agent, a transfer device for transferring the developing agent image onto a transfer medium, and a fixing device for fixing the developing agent image transferred to the transfer medium.

According to the third aspect of the present invention, there is provided an image forming method comprising an electrostatic latent image formation step of forming an electrostatic latent image on an image carrier, a developing step of developing an electrostatic latent image formed on the image carrier by using a developing agent, containing a binder resin, a magnetic particle, rutile/anatase mixed crystal type titanium oxide treated to have hydrophobicity, and silica treated to have hydrophobicity, to obtain a developing agent image a transfer step of transferring the obtained developing agent image onto a transfer medium, and a fixing step of fixing the developing agent image, transferred to the transfer medium.

In the present invention, rutile/anatase mixed crystal type titanium oxide that is made hydrophobic is mixed in toner containing a magnetic particle. This gives appropriate flowability to a developing agent to thereby stabilize charging property. Consequently, a high-quality image having high image density can be obtained.

BRIEF DESCRIPTION OF THE SEVERAL VIEWS OF THE DRAWING

A FIGURE is a schematic view showing an example of an image forming apparatus of the present invention.

DETAILED DESCRIPTION OF THE INVENTION

A developing agent of the present invention contains a magnetic particle, a binder resin, rutile/anatase mixed crystal type titanium oxide treated to have hydrophobicity, and silica treated to have hydrophobicity.

This developing agent of the present invention has high flowability and varies its charging property little with environmental changes. By the use of this developing agent, high-quality images having stable image density can be formed without any toner scattering or fog.

The developing agent can be constituted by toner particles containing primarily of a binder resin, rutile/anatase mixed crystal type titanium oxide treated to have hydrophobicity and mixed in the toner particles, and an additive containing silica treated to have hydrophobicity.

A magnetic particle can be added to the toner particles together with the binder resin.

The developing agent thus formed contains the toner particles containing the binder resin and the magnetic particle, the rutile/anatase mixed crystal type titanium oxide treated to have hydrophobicity, and the silica treated to have hydrophobicity. If necessary, the developing agent can also contain a colorant.

The magnetic particle can be added by mixing together with the toner particles containing the binder resin.

Examples of the magnetic particle used in the present invention are iron oxide such as magnetite, iron oxide such as ferrite containing another metal oxide, metals such as Fe, Co, and Ni, alloys of these metals and other metals such as Al, Co, Cu, Pb, Mg, Ni, Sn, Zn, Sb, Be, Bi, Cd, Ca, Mn, Se, Ti, W, and V, and mixtures of these materials.

This magnetic particle is a polygon having 10 or more surfaces and is preferably substantially spherical. The average particle size of the magnetic particle is preferably 0.1 to 0.5 $\mu$m. Magnetite particles are preferably used as this magnetic particle.

Preferably, 0.1 to 5.0 wt % of a silicon compound, as silicon (Si) with respect to iron (Fe), adhere to the surfaces of the magnetite particles.

If the adhesion amount of silicon (Si) to iron (Fe) is less than 0.1 wt %, the magnetic particles often assume positive charging property and hence can become unsuited to a negative charging developing agent. If the adhesion amount is larger than 5.0 wt %, negative charging property increases to allow easy occurrence of a charge-up phenomenon. This often gradually lowers image density in a low-temperature, low-humidity environment.

The shape of the magnetic particle can be polygonal, indeterminate, or spherical. However, polygonal particles are superior to indeterminate or spherical particles in the wettability to the binder resin and the dispersibility in the resin when kneaded with the resin.

If the particle size of the magnetic particle is smaller than 0.1 $\mu$m, the flocculation force between magnetic particles increases to make these particles difficult to loosen. This lowers the dispersibility to result in poor durability and image stability. If the particle size is larger than 0.5 $\mu$m, the magnetic substance does not uniformly mix with the toner particles. This makes it difficult to stabilize image properties, particularly halftone reproducibility and thin-line reproducibility, over long time periods in a low-temperature, low-humidity environment for a long period.

The bulk density of the magnetic particle used in the present invention is preferably 1.2 to 2.5 g/cm$^3$, and more preferably, 1.5 to 2.0 g/cm$^3$. If the bulk density is in this range, a magnetic particle having small flocculation force and high dispersibility is obtained. Since this increases the dispersibility of the magnetic particle in the binder resin during the manufacture of the developing agent, high coloring power and stable charging characteristics can be obtained.

The addition amount of the magnetic particle is preferably 30 to 60 wt %.

If the addition amount is 30 wt % or less, the image density significantly lowers even in a normal temperature, normal pressure environment. If the addition amount is 60% or more, isolated dots and fog in an image white portion often increase.

Fine titanium oxide particles usable in the present invention have a rutile/anatase mixed crystal.

Titanium oxide having a rutile type crystal structure has a high volume specific resistance and changes its charge amount little owing to the environment. However, this titanium oxide has small surface activity and cannot be sufficiently made hydrophobic. If a large amount of a hydrophobicity imparting agent or a highly viscous hydrophobicity imparting agent is used, coalesced particles may form in the stage of the hydrophobicity imparting process or the material may be nonuniformly given hydrophobicity, even though the degree of hydrophobicity can be increased. This makes the material inferior in environment dependence. Although the material can be made hydrophobic by an organic treatment after its surface is treated with an inorganic oxide, no satisfactory degree of hydrophobicity can be obtained.

Titanium oxide having an anatase type crystal structure has high flowability. However, this titanium oxide has a small volume specific resistance, causes charge leak early at high humidity, and lowers charging.

In contrast, rutile/anatase mixed crystal type titanium oxide can compensate for the drawbacks of both rutile type titanium oxide and anatase type titanium oxide. This rutile/anatase mixed crystal type titanium oxide can be made hydrophobic uniformly and sufficiently by a simple method without causing any coalescence of particles, and has an appropriate volume specific resistance.

The addition amount of rutile/anatase mixed crystal type titanium oxide used in the present invention is preferably 0.1 to 5.0 wt % with respect to the total toner particle weight. If the addition amount of rutile/anatase mixed crystal type titanium oxide is less than 0.1 wt %, the flowability of toner lowers, and this often deteriorates image density or solid-area density uniformity in a low-temperature, low-humidity environment. If the addition amount exceeds 5.0 wt %, the toner consumption amount increases or the amount of undeveloped toner increases, resulting in increased toner scattering.

The starting material, manufacturing method, and the like of rutile/anatase mixed crystal type titanium oxide used in the present invention are not restricted at all. However, this titanium oxide can be preferably obtained by a dry method.

In fine titanium oxide particles, the ratio of a rutile crystal to an anatase crystal is preferably 5:95 to 90:10. If this crystal ratio is smaller than 5:95, the volume specific resistance decreases, a charge leak occurs early at high humidity, and charging becomes unstable. If the crystal ratio is larger than 90:10, the surface activity becomes small, so the material is often not well given hydrophobic nature when a surface treatment is performed. Also, no larger hydrophobicity degree than 80% is often obtained.

The developing agent of the present invention further contains silica that is treated to have hydrophobicity as an additive to toner particles.

When silica treated to have hydrophobicity is added to toner particles, the flowability and the charging property further improve. Since this allows smooth conveyance of the developing agent to a developing roller, the solid-area following density also improves. Even when rutile/anatase mixed crystal type titanium oxide used in the present invention is used together with hydrophobic silica, no problem such as deterioration of the charging characteristics of toner arises.

If only silica treated to have hydrophobicity is added to the developing agent, it is difficult to increase the charging property and optimize the flowability. For example, if the amount of hydrophobic silica is increased, the flowability of toner improves, but the image density in a low-temperature, low-humidity environment decreases.

The addition amount of silica processed to have hydrophobicity is preferably 0.2 to 6.0 wt % with respect to the total amount of toner particles.

If the addition amount of silica is less than 0.2 wt %, the flowability of toner lowers to deteriorate the capability of conveyance to a sleeve, and this often lowers the image density and the solid-area density uniformity. If the addition amount of silica exceeds 6.0 wt %, the charge amount decreases in a high-temperature, high-humidity environment, and this often increases toner scattering.

In the present invention, silica treated to have hydrophobicity and rutile/anatase mixed crystal type titanium oxide treated to have hydrophobicity are used as additives and added to magnetic toner particles to prepare a developing agent. Consequently, these additives well disperse in the developing agent to achieve very high flowability as described above. Also, charge-up at high temperature and high humidity is suppressed, and this accomplishes triboelectrification properties having high environmental stability.

Examples of the binder resin preferably used in the present invention are homopolymers and copolymers of styrene and its substitution products, e.g., polystyrene, poly-p-chlorostyrene, polyvinyltoluene, a styrene-p-chlorostyrene copolymer, and a styrene vinyl toluene copolymer; copolymers of styrene and acrylic ester, e.g., a styrene-methyl acrylate copolymer, a styrene-ethyl acrylate copolymer, and a styrene-n-butyl acrylate copolymer; copolymers of styrene and methacrylic ester, e.g., a styrene-methyl methacrylate copolymer, a styrene-ethyl methacrylate copolymer, and a styrene-n-butyl methacrylate copolymer; a heteropolymer of styrene, ester acrylate, and ester methacrylate; styrene-based copolymers of styrene and other vinyl-based monomers, e.g., a styrene-acrylonitrile copolymer, a styrene vinyl methyl ether copolymer, a styrene butadiene copolymer, a styrene vinyl methylketone copolymer, a styrene acryl nitrile indene copolymer, and a styrene-maleic ester copolymer; and polymethylmethacrylate, polybutylmethacrylate, vinyl polyacetate polyester, polyamide, epoxy resin, polyvinylbutyral, phenol polyacrylate resin, aliphatic or alicyclic hydrocarbon resin, petroleum resin, and chlorinated paraffin. These resins can be used singly or mixedly.

Furthermore, in the developing agent of the present invention, as the binder resin of the developing agent to be subjected to pressure-fixing, it is possible to use, singly or mixedly, low-molecular polyethylene, low-molecular polypropylene, an ethylene vinyl acetate copolymer, an ethylene acrylic ester copolymer, higher fatty acid, polyamide resin, and polyester resin.

The binder resin is more preferably a polymer, copolymer, or polblend containing 40 wt % or more of a vinyl aromatic or acryl-based monomer represented by styrene.

In the present invention, the binder resin described above is used in an amount of 40 to 80 wt % in magnetic toner particles. If the amount of binder resin is less than the above range, the electrical characteristics and fixing properties of the magnetic toner often degrade. If the amount of binder resin is larger than the above range, the amount of magnetic particle becomes relatively small. This makes the magnetic characteristics of the toner unsatisfactory and also makes the capability of conveyance of the developing agent to a developing sleeve in a developing device unsatisfactory. As a consequence, the developing efficiency often lowers.

If necessary, a charge controller, a colorant, and a flowability modifier can be added to the magnetic toner particles of the present invention. Also, the charge controller and the flowability modifier can be mixed in the toner particles such that these additives exist on the surfaces of the toner particles.

Examples of this charge controller are a metal-containing dye and nigrosine.

As the colorant, dyes and pigments conventionally used in developing agents can be used. If a sufficient amount of a magnetic power having satisfactory coloring properties is contained, the addition of the colorant can be omitted.

Examples of the flowability modifier are colloidal silica and fatty acid metal salt.

As a means for imparting, e.g., charge stability, flowability, and duration stability to the developing agent, other fine particles can be added to the surfaces of the toner particles.

For example, it is possible to add a charge controller such as fine chargeable particles to toner, to use a fine resin powder having opposite polarity to that of toner, and to add a fluorine-containing compound to the developing agent.

An image forming apparatus of the present invention is an apparatus for forming an image by using the developing agent described above, and comprises an image carrier, a developing device provided opposite to the image carrier to form a developing agent image by developing an electrostatic latent image formed on the image carrier by using the developing agent, a transfer device for transferring the developing agent image onto a transfer medium, and a fixing device for fixing the developing agent image transferred to the transfer medium, wherein the developing device contains a developing agent which contains a binder resin, a magnetic particle, rutile/anatase mixed crystal type titanium oxide treated to have hydrophobicity, and silica treated to have hydrophobicity.

An image forming method of the present invention is a method of forming an image by using the apparatus above, and comprises an electrostatic latent image formation step of forming an electrostatic latent image on an image carrier, a developing step of obtaining a developing agent image by developing the electrostatic latent image formed on the image carrier by using a developing agent, a transfer step of transferring the developed developing agent image onto a transfer medium, and a fixing step of fixing the developing agent image, transferred to the transfer medium, on the transfer medium, wherein the developing agent contains a binder resin, a magnetic particle, rutile/anatase mixed crystal type titanium oxide treated to have hydrophobicity, and silica treated to have hydrophobicity.

The present invention will be described in more detail below with reference to the accompanying drawing.

The FIGURE is a schematic view showing an example of the image forming apparatus of the present invention.

With reference to this FIGURE, a developing device 11 opposes a rotatable photoreceptor drum 3. This photoreceptor drum 3 is rotated in the direction of an arrow a by a main motor (not shown). On the surface of the photoreceptor drum 3, an electrostatic latent image corresponding to image information to be recorded is formed by a laser beam L from a laser exposure device (not shown).

Around the photoreceptor drum 3, a charger 5, the developing device 11, a transfer device 21, a cleaning device 25, and a charge removal unit 29 are arranged in this order along the arrow a as the rotating direction of the photoreceptor drum 3. The charger 5 charges the photoreceptor drum 3 to a predetermined potential. The developing device 11 supplies toner to an electrostatic latent image formed on the photoreceptor drum 3 to visualize this electrostatic latent image, thereby forming a toner image. The transfer device 21 transfers the toner image formed on the photoreceptor drum 3 onto a paper sheet. The cleaning device 25 scrapes off residual toner, i.e., untransferred toner from the surface of the photoreceptor drum 3. The charge removal unit 29 removes the charge remaining on the surface of the photoreceptor drum 3. Furthermore, a fixing device 35 is placed downstream from the transfer device. The developing device 11 contains toner T which contains toner particles containing a binder resin and a magnetic particle, rutile/anatase mixed crystal type titanium oxide treated to have hydrophobicity, and silica treated to have hydrophobicity. Also, a toner charge removal unit for facilitating removal of untransferred toner can be placed between the cleaning device 25 and the transfer device 21. Additionally, another charge removal unit can be placed between the developing device 11 and the transfer device to facilitate transfer of toner to a paper sheet.

The charger 5 includes a corona wire and a grid screen and is connected to a high-voltage circuit and a grid bias voltage generator. The surface of the photoreceptor drum 3 can be charged to a predetermined surface potential by using the charger 5. The developing device 1 forms a toner layer on a developing agent carrier (developing roller) by the toner T and brings this developing roller into contact with the opposing photoreceptor drum 3 on which an electrostatic latent image is formed, thereby developing and visualizing the electrostatic latent image.

The developing roller is applied with an AC voltage on which a DC voltage is superposed via a developing bias voltage generator (not shown).

As a means for conveying paper sheets, an annular belt 38 made of, e.g., polyamide is used. A paper sheet conveyed by this conveyor means comes in contact with the photoreceptor drum. At this contact position between the paper sheet and the photoreceptor drum, a power-supply roller 39 as a transfer means is placed.

The fixing device 35 is composed of a heat roller 36 for heating toner and a press roller 37 for holding.

Examples of the toner according to the present invention will be described below.

EXAMPLE 1

A toner particle material having the following composition was prepared.

Toner particle material composition

| | |
|---|---|
| Styrene acrylic resin<br>CPR100 (Mitsui Toatsu Chemicals, Inc.) | 49% |
| Magnetic particle<br>EPT1002 (TODA KOGYO CORP.) | 50% |
| Charge controller<br>TRH (Hodogaya Chemical Co., Ltd.) | 1% |

The material having the composition above was mixed and dispersed by a high-speed fluid type mixer, and heated, melted, and kneaded to obtain a kneaded product. The obtained kneaded product was cooled, pulverized, and classified to obtain toner particles having a particle size of 10 $\mu$m.

0.5 parts by weight of hydrophobic silica and 0.5 parts by weight of rutile/anatase mixed crystal type titanium oxide that was made hydrophobic were mixed in 100 parts by weight of the obtained toner particles by a high-speed mixer, thereby obtaining toner.

The obtained toner was evaluated by measuring the flowability and also measuring the charge amount, image density, and solid-area following density at low temperature and low humidity and at high temperature and high humidity. Note that FAX; TF631 manufactured by TOSHIBA TECH CORP. was used in a copy test.

The flowability was evaluated by measuring the residual toner amount (g) on #200MESH by using a powder tester manufactured by HOSOKAWA MICRON CORP. The evaluation was ○ when the amount was less than 5 g and X when the amount exceeded 5 g.

The charge amount was measured in a low-temperature, low-humidity condition at a temperature of 10° C. and a humidity of 20% and in a high-temperature, high-humidity condition at a temperature of 30° C. and a humidity of 85%, by using a TB-220 blow-off powder charge amount measuring device available from TOSHIBA CHEMICAL CORP.

A method of forming charge amount measurement samples will be described below.

First, toner was sampled from the developing device. This toner was mixed with a carrier. After that, the charge amount of a developing agent obtained by stirring by a ball mill was measured. A correlation between image density and fog was found, although it was different from the charge amount mechanism of the TF631.

The image density was evaluated by measuring a black portion of an image by an RD-914 Macbeth densitometer available from Macbeth Corp. The evaluation was ○ when the image density was 1.3 or more and X when the image density was less than 1.3.

The solid-area following density was visually evaluated by forming a solid image. The evaluation was ○ if toner uniformly spread on the entire paper surface and X if not.

The fog was evaluated by measuring $\Delta Y$ of a white portion of an image by a colorimeter/color difference meter manufactured by MINOLTA CAMERA CO., LTD. The evaluation was ○ when the value was less than 1.5 and X when the value was 1.5 or more.

Consequently, both flowability and solid-area following density were good. When the charge amount was measured at low temperature and low humidity, no charge-up occurred. Accordingly, a satisfactory image density was obtained. Also, when the charge amount was measured at high temperature and high humidity, no charge-down occurred. Hence, good images having no fog were obtained. The results are shown in Table 1 presented later.

EXAMPLE 2

0.2 parts by weight of hydrophobic silica and 0.5 parts by weight of rutile/anatase mixed crystal type titanium oxide that was made hydrophobic were mixed in 100 parts by weight of toner particles similar to Example 1 by using a high-speed mixer, thereby obtaining toner.

The obtained toner was used to perform measurements and evaluations analogous to Example 1. The results are shown in Table 1.

EXAMPLE 3

1 part by weight of hydrophobic silica and 0.5 parts by weight of rutile/anatase mixed crystal type titanium oxide that was made hydrophobic were mixed in 100 parts by weight of toner particles similar to Example 1 by using a high-speed mixer, thereby obtaining toner.

The obtained toner was used to perform measurements and evaluations analogous to Example 1. The results are shown in Table 1.

EXAMPLE 4

2 parts by weight of hydrophobic silica and 1 part by weight of rutile/anatase mixed crystal type titanium oxide that was made hydrophobic were mixed in 100 parts by weight of toner particles similar to Example 1 by using a high-speed mixer, thereby obtaining toner.

The obtained toner was used to perform measurements and evaluations analogous to Example 1. The results are shown in Table 1.

EXAMPLE 5

6 parts by weight of hydrophobic silica and 3 parts by weight of rutile/anatase mixed crystal type titanium oxide that was made hydrophobic were mixed in 100 parts by weight of toner particles similar to Example 1 by using a high-speed mixer, thereby obtaining toner.

The obtained toner was used to perform measurements and evaluations analogous to Example 1. The results are shown in Table 1.

Comparative Example 1

Toner was obtained by mixing only 0.2 parts by weight of hydrophobic silica in 100 parts by weight of toner particles similar to Example 1 by using a high-speed mixer.

The obtained toner was used to perform measurements and evaluations analogous to Example 1. The results are shown in Table 1.

Since no rutile/anatase mixed crystal type titanium oxide was added, the flowability of the obtained toner deteriorated. Also, the solid-area following density was bad in the formed image.

Comparative Example 2

Toner was obtained by mixing only 0.5 parts by weight of hydrophobic silica in 100 parts by weight of toner particles similar to Example 1 by using a high-speed mixer.

The obtained toner was used to perform measurements and evaluations analogous to Example 1. The results are shown in Table 1.

Since no rutile/anatase mixed crystal type titanium oxide was added, the flowability of the obtained toner suffered. Also, the solid-area following density was bad in the formed image.

Comparative Example 3

Toner was obtained by mixing only 1 part by weight of hydrophobic silica in 100 parts by weight of toner particles similar to Example 1 by using a high-speed mixer.

The obtained toner was used to perform measurements and evaluations analogous to Example 1. The results are shown in Table 1.

The flowability of the obtained toner was good because the addition amount of silica was large. However, since no rutile/anatase mixed crystal type titanium oxide was added, charge-up occurred in a low-temperature, low-humidity environment, so no satisfactory image density could be obtained.

Comparative Example 4

Toner was obtained by mixing 0.5 parts by weight of hydrophobic silica and 0.5 parts by weight of anatase type titanium oxide in 100 parts by weight of toner particles similar to Example 1 by using a high-speed mixer.

The obtained toner was used to perform measurements and evaluations analogous to Example 1. The results are shown in Table 1.

Since anatase type titanium oxide less depending on environment was added, a large charge-down occurred in a high-temperature, high-humidity environment, and the fog deteriorated.

Comparative Example 5

Toner was obtained by mixing 0.5 parts by weight of hydrophobic silica and 0.5 parts by weight of rutile type titanium oxide in 100 parts by weight of toner particles similar to Example 1 by using a high-speed mixer.

The obtained toner was used to perform measurements and evaluations analogous to Example 1. The results are shown in Table 1.

Since rutile type titanium oxide less depending on environment was added, a large charge-down occurred in a high-temperature, high-humidity environment, and the fog deteriorated.

TABLE 1

| | Silica amount (%) | Titanium crystal type | Titanium amount (%) | Flow-ability | Charge amount (μc/g) (L/L) | Charge amount (μc/g) (H/H) | Image density (L/L) | Fog (H/H) | Solid-area density uniformity |
|---|---|---|---|---|---|---|---|---|---|
| Comparative Example 1 | 0.2 | — | — | X | 14 | 12 | ○ | ○ | X |
| Comparative Example 2 | 0.5 | — | — | X | 21 | 18 | ○ | ○ | X |
| Comparative Example 3 | 1 | — | — | ○ | 27 | 21 | X | ○ | ○ |
| Comparative Example 4 | 0.5 | Anatase | 0.5 | ○ | 17 | 6 | ○ | X | ○ |
| Comparative Example 5 | 0.5 | Rutile | 0.5 | ○ | 18 | 7 | ○ | X | ○ |
| Example 1 | 0.5 | Mixed crystal | 0.5 | ○ | 18 | 16 | ○ | ○ | |
| Example 2 | 0.2 | Mixed crystal | 0.5 | ○ | 11 | 10 | ○ | ○ | ○ |
| Example 3 | 1 | Mixed crystal | 0.5 | ○ | 20 | 18 | ○ | ○ | ○ |

TABLE 1-continued

| | Silica amount (%) | Titanium crystal type | Titanium amount (%) | Flow-ability | Charge amount (μc/g) (L/L) | Charge amount (μc/g) (H/H) | Image density (L/L) | Fog (H/H) | Solid-area density uniformity |
|---|---|---|---|---|---|---|---|---|---|
| Example 4 | 2 | Mixed crystal | 1 | ○ | 21 | 18 | ○ | ○ | ○ |
| Example 5 | 6 | Mixed crystal | 3 | ○ | 20 | 17 | ○ | ○ | ○ |

What is claimed is:

1. A developing agent containing a binder resin, a magnetic particle, rutile/anatase mixed crystal type titanium oxide treated to have hydrophobicity, and silica treated to have hydrophobicity.

2. A developing agent according to claim 1, further containing a colorant.

3. A developing agent according to claim 1, wherein the addition amount of said rutile/anatase mixed crystal type titanium oxide treated to have hydrophobicity is 0.1 to 5.0 wt % of a total toner particle weight.

4. A developing agent according to claim 1, wherein the content of said magnetic particle is 30 to 60 wt % of a total toner particle weight.

5. A developing agent according to claim 1, wherein the addition amount of said silica treated to have hydrophobicity is 0.2 to 6.0 wt % of a total toner particle weight.

6. A developing agent according to claim 1, wherein in said rutile/anatase mixed crystal type titanium oxide treated to have hydrophobicity, the ratio of a rutile type crystal to an anatase type crystal is 5:95 to 90:10.

7. An image forming apparatus comprising:

an image carrier;

a developing device provided opposite to said image carrier and containing a developing agent which contains a binder resin, a magnetic particle, rutile/anatase mixed crystal type titanium oxide treated to have hydrophobicity, and silica treated to have hydrophobicity, said developing device forming a developing agent image by developing an electrostatic latent image formed on said image carrier by using said developing agent;

a transfer device for transferring the developing agent image onto a transfer medium; and a fixing device for fixing the developing agent image transferred to said transfer medium.

8. An apparatus according to claim 7, further containing a colorant.

9. An apparatus according to claim 7, wherein the addition amount of said rutile/anatase mixed crystal type titanium oxide treated to have hydrophobicity is 0.1 to 5.0 wt % of a total toner particle weight.

10. An apparatus according to claim 7, wherein the content of said magnetic particle is 30 to 60 wt % of a total toner particle weight.

11. An apparatus according to claim 7, wherein the addition amount of said silica treated to have hydrophobicity is 0.2 to 6.0 wt % of a total toner particle weight.

12. An apparatus according to claim 7, wherein in said rutile/anatase mixed crystal type titanium oxide treated to have hydrophobicity, the ratio of a rutile type crystal to an anatase type crystal is 5:95 to 90:10.

13. An image forming method comprising:

an electrostatic latent image formation step of forming an electrostatic latent image on an image carrier;

a developing step of developing an electrostatic latent image formed on said image carrier by using a developing agent containing a binder resin, a magnetic particle, rutile/anatase mixed crystal type titanium oxide processed to have hydrophobicity, and silica processed to have hydrophobicity, and obtaining a developing agent image;

a transfer step of transferring the developed developing agent image onto a transfer medium; and a fixing step of fixing the developing agent image, transferred to said transfer medium, on said transfer medium.

14. A method according to claim 13, further containing a colorant.

15. A method according to claim 13, wherein the addition amount of said rutile/anatase mixed crystal type titanium oxide treated to have hydrophobicity is 0.1 to 5.0 wt % of a total toner particle weight.

16. A method according to claim 13, wherein the content of said magnetic particle is 30 to 60 wt % of a total toner particle weight.

17. A method according to claim 13, wherein the addition amount of said silica treated to have hydrophobicity is 0.2 to 6.0 wt % of a total toner particle weight.

18. A method according to claim 13, wherein in said rutile/anatase mixed crystal type titanium oxide treated to have hydrophobicity, the ratio of a rutile type crystal to an anatase type crystal is 5:95 to 90:10.

* * * * *